US006386371B1

(12) United States Patent
Parsons

(10) Patent No.: US 6,386,371 B1
(45) Date of Patent: May 14, 2002

(54) DISPLAY DEVICE

(75) Inventor: Kevin L. Parsons, Appleton, WI (US)

(73) Assignee: Armament Systems and Procedures, Inc., Appleton, WI (US)

( * ) Notice: Subject to any disclaimer, the term of this patent is extended or adjusted under 35 U.S.C. 154(b) by 0 days.

(21) Appl. No.: 09/566,358

(22) Filed: May 8, 2000

(51) Int. Cl.[7] ..... B65D 25/00
(52) U.S. Cl. ..... 206/768; 206/485
(58) Field of Search ..... 206/756, 766, 206/767, 768, 45.28, 45.29, 774, 456, 485

(56) References Cited

U.S. PATENT DOCUMENTS 1,684,579 A * 9/1928 Ferguson et al. ..... 206/485
1,803,028 A * 4/1931 Menten ..... 206/485
2,630,914 A * 3/1953 Bekoff ..... 206/485
2,813,621 A * 11/1957 Parker, II ..... 206/485
3,314,530 A * 4/1967 Michalka ..... 206/756
3,326,361 A * 6/1967 Zimmerman ..... 206/768
3,358,819 A * 12/1967 Johnson ..... 206/756
3,674,133 A * 7/1972 Locke ..... 206/768
3,927,761 A * 12/1975 Boyle ..... 206/485
4,025,039 A * 5/1977 Croll et al. ..... 206/491
4,201,291 A * 5/1980 Davidson ..... 206/45.29
4,542,847 A * 9/1985 Lindstrom ..... 206/766
5,505,309 A * 4/1996 Taravella et al. ..... 206/485
5,577,606 A * 11/1996 Schwentuchowski et al. .... 206/485
5,597,070 A * 1/1997 Wu ..... 206/419
5,979,662 A * 11/1999 Green ..... 206/764

* cited by examiner

*Primary Examiner*—Shzan Luung
(74) *Attorney, Agent, or Firm*—Welsh & Katz, Ltd.

(57) ABSTRACT

The present invention further provides a display having a header for advertising the product. Once an outer shipping box is removed from the display, the header is moved from its folded, storage position to its extended position. The display is provided with a locking member that locks the header in its extended position. Since the header is attached to the display, the likelihood of the header being lost or misplaced is eliminated. Further, errors in setting up the display are avoided.

21 Claims, 3 Drawing Sheets

DISPLAY DEVICE

FIELD OF THE INVENTION

This invention relates to display devices and, more particularly, to a display having a header for displaying and advertising a product.

BACKGROUND OF THE INVENTION

Display devices are well-known in the retail industry. They range from full-length floor displays to counter-top displays. These devices may function to house products during transport as well as to display and advertise the products in the retail environment. Some displays require extensive assembly, which is time-consuming and sometimes confusing.

To advertise the products contained therein, displays are provided with separate headers. The advertising material is often printed on the header or otherwise affixed onto the header. The header is then attached to the display by means of a wire, a separate piece of cardboard, adhesives, or some combination thereof.

There are several disadvantages with the known displays. Since the header is a separate piece, it has a tendency to become lost. Thus, the resulting display is incomplete and not as effective with respect to its advertising appeal. In addition, difficulty is occasionally experienced in assembling the displays. In particular, attaching the header to the display can often be problematic. Oftentimes, store personnel are unable to properly build the display and/or properly attach the header. As a result, the display is incorrectly set up, thereby diminishing its advertising potential.

Thus, there is a need in the art for a display for displaying a product that reduces any required assembly.

There is a further need in the art for a display for displaying a product that is provided with a header for advertising the product.

SUMMARY OF THE INVENTION

The present invention meets the needs of the prior art by providing a display that reduces the assembly requirements. Once the display is received, its outer shipping box is removed and the display can be placed in the retail environment. The product to be displayed has been previously placed within the display. Thus, no assembly is required to prepare the display for use. As a result, the display can be set up quickly and with little to no difficulty.

The present invention further provides a display having a header for advertising the product. Once the outer shipping box is removed, the header is moved from its folded, storage position to its extended position. The display is provided with a locking member that locks the header in its extended position. Since the header is attached to the display, the likelihood of the header being lost or misplaced is eliminated. Further, errors in setting up the display are avoided.

DETAILED DESCRIPTION OF THE INVENTION

Figure 2:
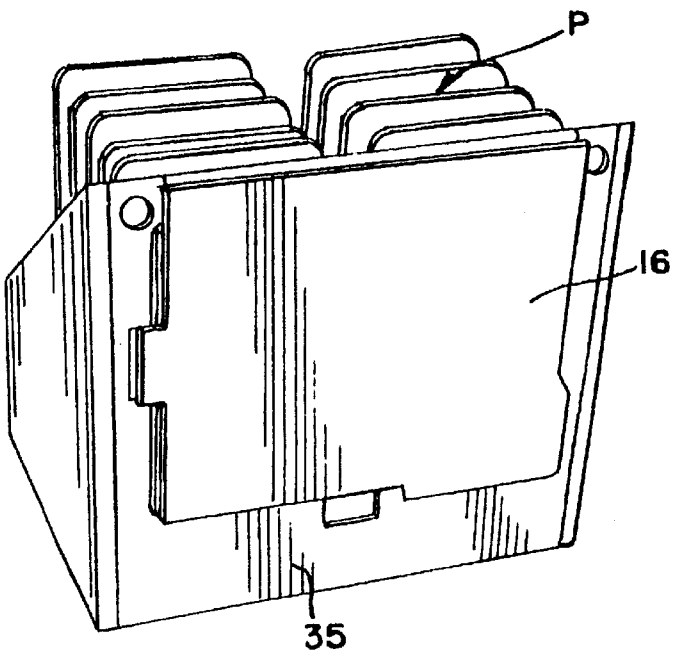
FIG. 2 is a perspective view of the display of FIG. 1, showing the header in its folded position.
Figure 1:
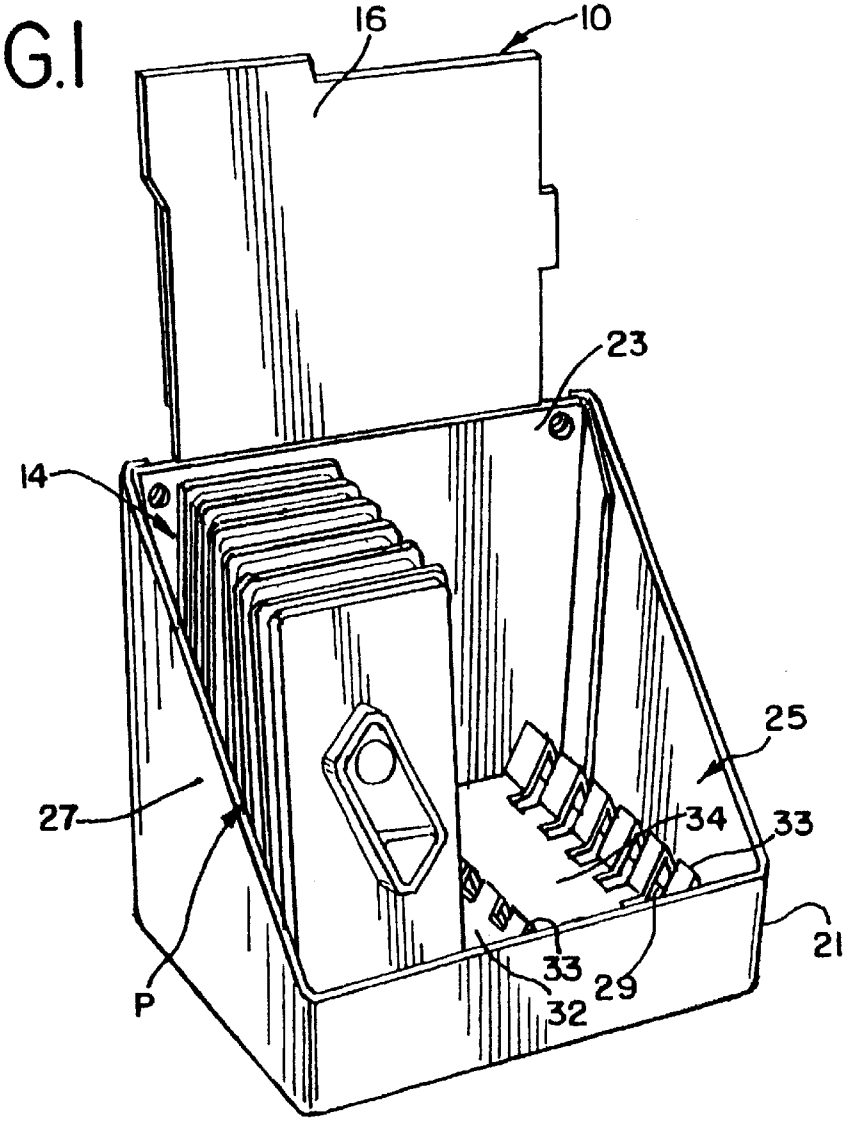
FIG. 1 is a perspective view of a display made in accordance with the principles of the present invention.

The present invention is directed to a display depicted in FIGS. 1–6. The display 10 generally comprises a product compartment 14, a header 16, and a locking member 18.

The product compartment 14 of the display 10 is formed by a plurality of walls. As can be seen from the figures, the plurality of walls comprises a front wall 21, a back wall 23, two sidewalls 25, 27, and a bottom wall 29. The walls are preferably constructed of a heavy cardboard. Further, the front wall 21 and the sidewalls 25, 27 can be provided with advertising for the product to be displayed.

In the embodiment depicted in FIGS. 1–6, the front wall 21 is shorter than the back wall 23, and the sidewalls 25, 27 are sloped and gradually increase in height from the front wall 21 to the back wall 23. The height dimensions of the walls, however, depend upon the product to be displayed.

As can be seen in FIGS. 1–6, the product compartment 14 is provided with a fluted or ridged surface 32 for supporting the product to be displayed. In particular, each product is supported by a pair of ridges 33 having a flat surface 34 extending therebetween. In the depicted embodiment, two sets of fluted surfaces are provided to support two rows of product. This arrangement is particularly helpful for use with products individually packaged in a rectangular bottomed clamshell. The exact configuration of the support surface depends upon the size or number of products to be displayed.

Figure 3:
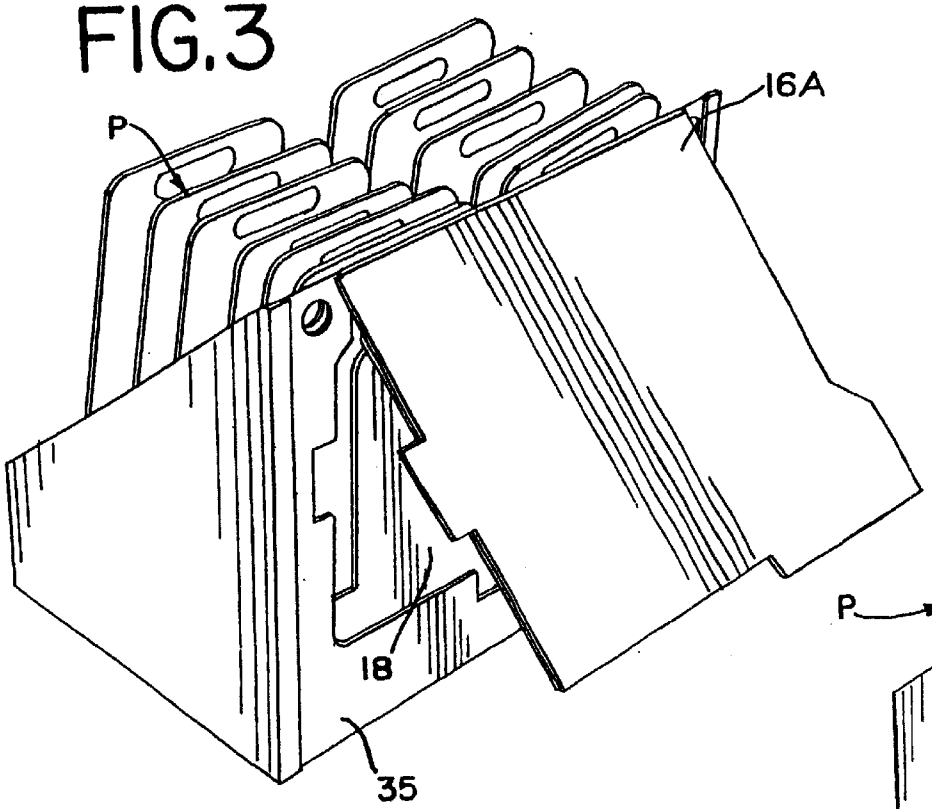
FIG. 3 is a perspective view of the display of FIG. 1, showing the header between its folded position and its extended position.
Figure 5:
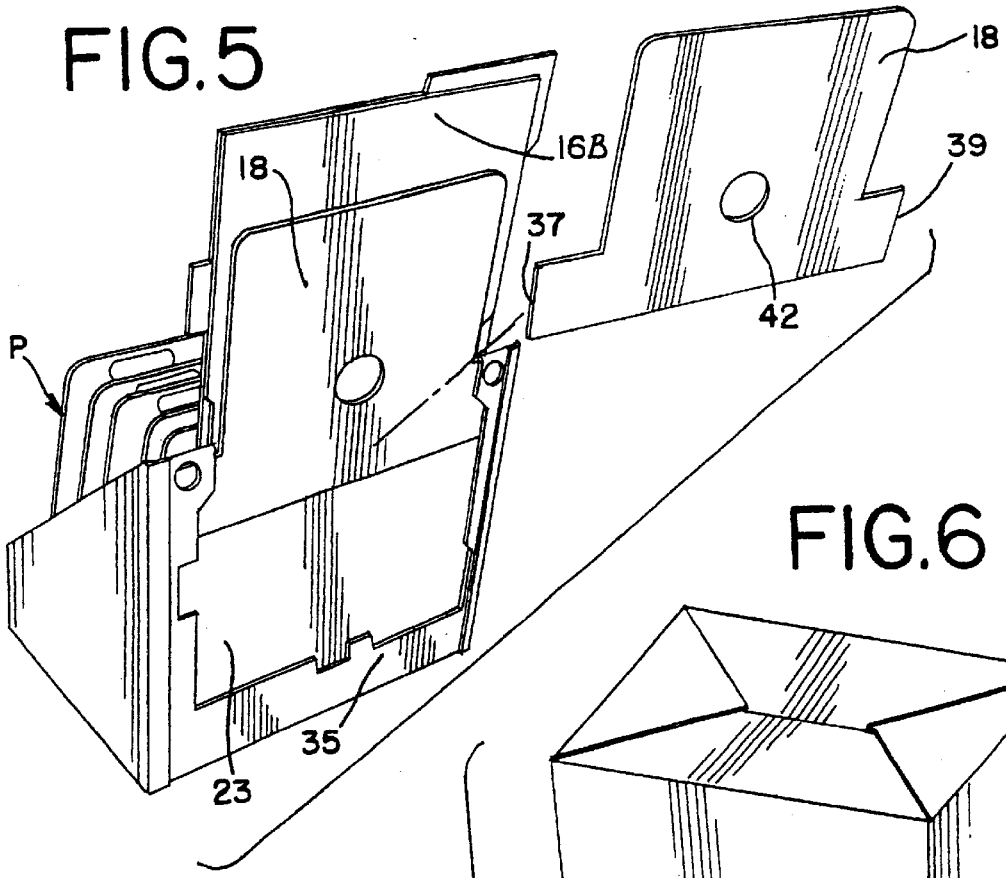
FIG. 5 is a perspective, partially exploded view of the display of FIG. 1, showing the locking member in its extended position.

Referring to FIGS. 3 and 5, the display 10 is further provided with a second, outer back wall 35 and a header 16. In a preferred embodiment, the header 16 can be a separate piece of cardboard that is affixed to a cut-out portion of the back wall 35 by an adhesive or the like, the cutout portion of the back wall 35 being hinged to the top surface of the inner back wall 23. Alternately, the header 16 can be a cutout portion of the outer back wall 35 that is hinged to the top surface of the inner back wall 23. In yet another embodiment, the header 16 can be a separate piece of cardboard that is affixed to the back wall 23 along its top surface by an adhesive strip or the like. A common feature in all these embodiments is that the header is attached to the display and ready for use before the display is shipped. In a preferred embodiment, the header 16 can be provided with graphical indicia for advertising the product to be displayed.

The display 10 is further provided with locking member 18. As can be seen in FIG. 3, the locking member 18 is positioned between the inner back wall 23 and outer back wall 35. Referring to FIG. 5, locking member 18 is provided with tabs 37, 39 for use in locking the header 16 in its extended position and means 42 for moving the locking member between its non-extended and extended positions. Tabs 37 and 39 remain positioned between the inner back wall 23 and a portion of the outer back wall 35. In the depicted embodiment, the moving means 42 comprises a cut-out for inserting a user's finger. The moving means, however, are not limited to the cut-out shown and could take alternate, equivalent embodiments including one or more attachments for grasping, to allow the header to be raised into position.

Figure 6:
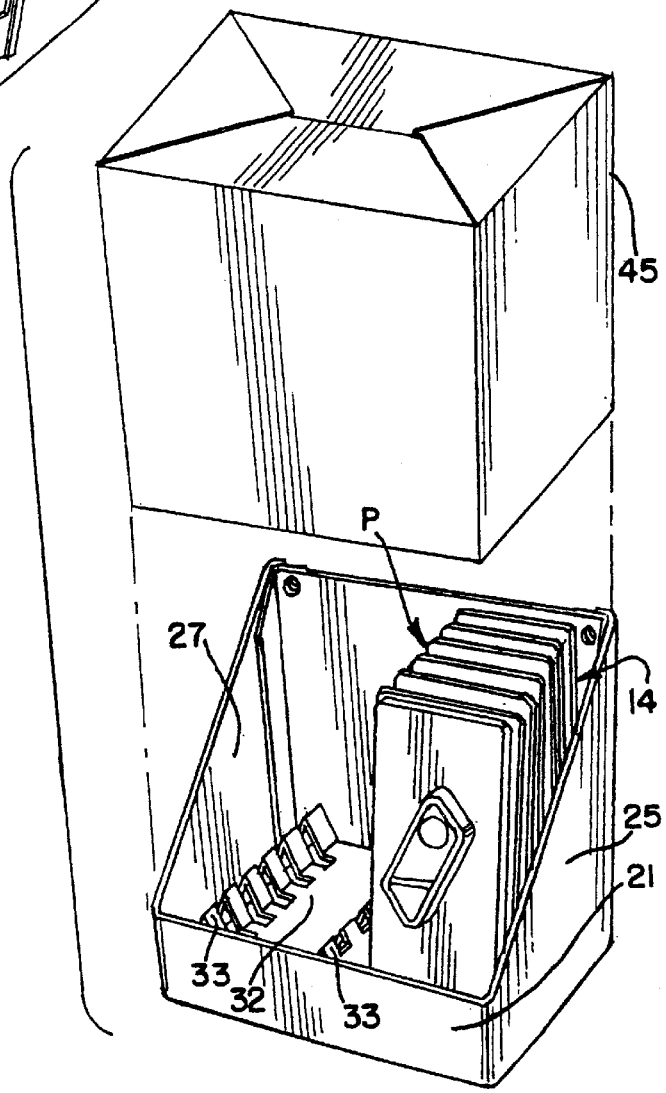
FIG. 6 is a perspective view of the display of FIG. 1, showing the outer shipping box that is used with the display.

During shipping, an outer shipping box is provided over the display 10. As can be seen in FIG. 6, the outer shipping box 45 preferably covers the four sides of the display and the top, but leaves the bottom wall upon which the display rests uncovered. Thus, the shipping box can be removed by simply lifting it off of the display.

Once the display 10 reaches its final destination, such as a retail environment, the outer shipping box is removed. After the box is removed, the display 10 is as shown in FIGS. 2 and 6. Specifically, the header 16 is in its first, folded position, flush with the remaining portion of the outer back wall 35. The locking member 18 is sandwiched between the inner back wall 23 and the outer back wall 35. The product P has been previously placed within the compartment 14 and is supported by the ridges of surface 32.

Figure 4:
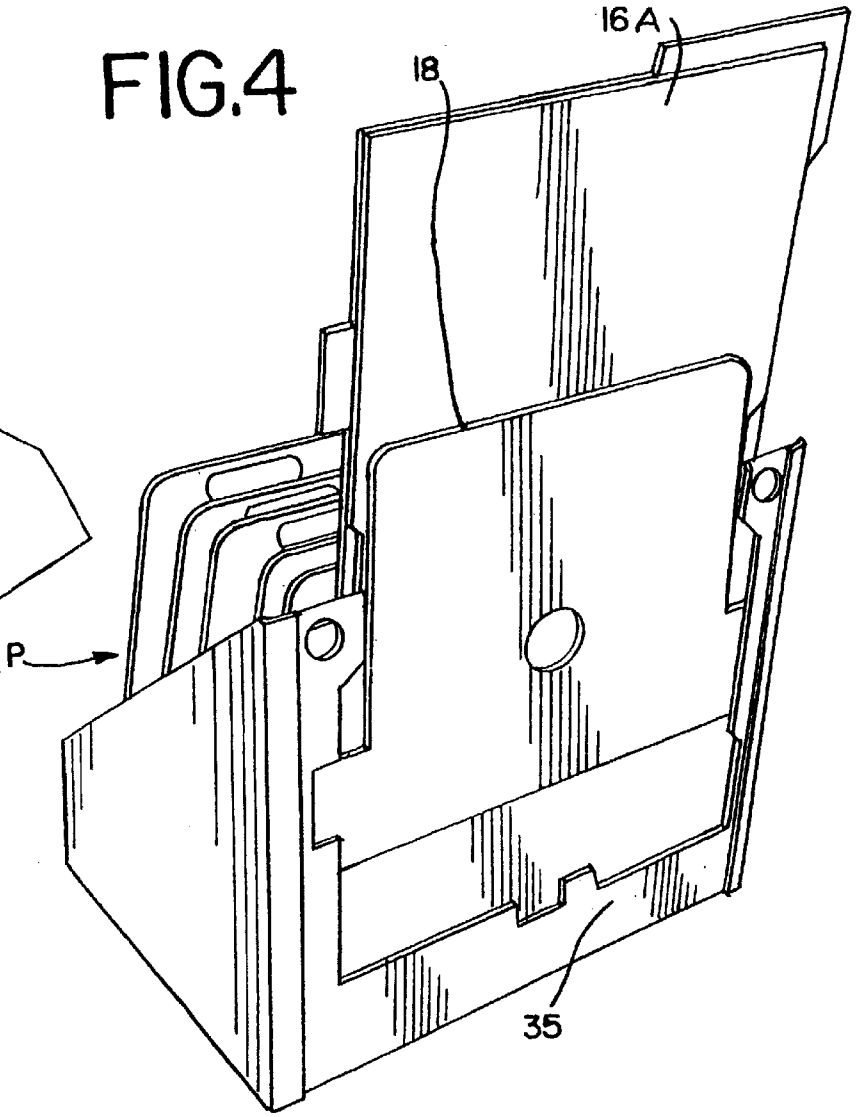
FIG. 4 is a perspective view of the display of FIG. 1, showing the locking member between its non-extended position and its extended position.

To set up the display for use, the header 16 is moved to its second extended position as depicted in FIG. 4. To lock the header in its extended position, the locking member 18 is slid from its first, non-extended position to its second, extended position, as shown in FIGS. 4 and 5. The user employs means 42 to move the locking member 18 between its two positions. The tabs 37 and 39 of the locking member 18 frictionally engage the back walls 23 and 35, adjacent the top surface along which the two walls are joined. This engagement locks the header 16 in its extended position.

Since the display 10 is provided with header 16, the display requires little assembly. Thus, the use of tools or the necessity of additional elements such as wire or adhesive is avoided. Further, since the header 16 is attached to the display 10, the tendency to lose the header is eliminated.

While the invention has been described in connection with certain embodiments, it should be understood that it is not intended to limit the invention to these particular embodiments. To the contrary, it is intended to cover all alternatives, modifications and equivalents falling within the spirit and scope of the invention.

What is claimed is:

1. A display comprising:

a plurality of walls including a front wall, at least a first back wall, a second back wall positioned behind the first back wall, two side walls, and a bottom wall, the walls forming a compartment for displaying a product; and a header hinged to the back wall, the header having graphical indicia relating to the product, said header is comprised of a cutout portion of the second back wall and wherein the header has a first, folded down position behind the back wall for use during storage and transport, movable to a second, extended position above the back wall for displaying graphical indicia relating to the product.

2. The display of claim 1 further comprising an upwardly moveable locking member for locking the header in its extended position.

3. The display of claim 2 wherein the locking member is movable between a first, non-extended position in which it is sandwiched between the first and second back walls, and a second, extended position in which it locks the header in its extended position.

4. The display of claim 3 wherein the locking member is provided with a means for moving the locking member between its two positions.

5. The display of claim 4 wherein the moving means comprises a cut-out in the locking member.

6. The display of claim 3 wherein the bottom wall is provided with a surface for supporting the product within the compartment.

7. The display of claim 6 wherein the support surface comprises pairs of ridges with flat surfaces extending between the ridges of each pair.

8. The display of claim 7 wherein the pairs of ridges have rectangular clamshell packages therein.

9. The display of claim 6 further including a shipping box enclosing the entire display except for the bottom wall.

10. A display comprising:

a plurality of walls including a front wall, at least a first back wall, a second back wall positioned behind the first back wall, two side walls, and a bottom wall, the walls forming a compartment for displaying a product;

a header hinged to the back wall, the header having graphical indicia relating to the product, said header is comprised of a cutout portion of the second back wall and wherein the header has a first, folded down position behind the back wall for use during storage and transport, movable to a second, extended position above the back wall for displaying graphical indicia relating to the product; and an upwardly moveable locking member for locking the header in its extended position, said locking member is provided with tabs for frictionally engaging the first and the second back walls in order to lock the header in its extended position.

11. The display of claim 1 further including a shipping box enclosing the entire display except for the bottom wall.

12. A display comprising:

a plurality of walls including a front wall, at least a first back wall, a second back wall positioned behind the first back wall, two side walls, and a bottom wall, the walls forming a compartment for displaying a product;

a header hinged to the back wall, the header having graphical indicia relating to the product, said header is comprised of a cutout portion of the second back wall and wherein the header has a first, folded down position behind the back wall for use during storage and transport, movable to a second, extended position above the back wall for displaying graphical indicia relating to the product; and an upwardly moveable locking member for locking the header in its extended position, said locking member is positioned between the first back wall and the second back wall when the header is in the folded position.

13. The display of claim 12 wherein the bottom wall is provided with a surface for supporting the product within the compartment.

14. The display of claim 13 wherein the support surface comprises pairs of ridges with flat surfaces extending between the ridges of each pair.

15. The display of claim 14 wherein the pairs of ridges have rectangular clamshell packages therein.

16. The display of claim 13 further including a shipping box enclosing the entire display except for the bottom wall.

17. A display comprising:

a compartment for displaying a product, said compartment has a second back wall positioned behind a first back wall; a header hinged to the compartment, the header having graphical indicia relating to the product, said header is comprised of a cutout portion of the second back wall, and wherein the header has a first, folded down position for use during storage and transport, movable to a second, extended position for displaying graphical indicia relating to the product; and an upwardly moveable locking member for locking the header in its extended position.

18. The display of claim 17 further including a shipping box enclosing the entire display except for the bottom wall.

19. A display comprising:

a compartment for displaying a product, said compartment further has a second back wall positioned behind a first back wall;

a header hinged to the compartment, the header having graphical indicia relating to the product, said header is comprised of a cutout portion of the second back wall, and wherein the header has a first, folded down position for use during storage and transport, movable to a second, extended position for displaying graphical indicia relating to the product; and an upwardly moveable locking member for locking the header in its extended position, said locking member is positioned between the first back wall and the second back wall when the header is in the folded position.

20. A display comprising:

a compartment for displaying a product, said compartment has a second back wall positioned behind a first back wall;

a header hinged to the compartment, the header having graphical indicia relating to the product, said header is comprised of a cutout portion of the second back wall, and wherein the header has a first, folded down position for use during storage and transport, movable to a second, extended position for displaying graphical indicia relating to the product; and an upwardly moveable locking member for locking the header in its extended position, said locking member is movable between a first, nonextended position in which it is sandwiched between the first and second back walls, and a second, extended position in which it locks the header in its extended position.

21. A display comprising:

a compartment for displaying a product, said compartment has a second back wall positioned behind a first back wall;

a header hinged to the compartment, the header having graphical indicia relating to the product, said header is comprised of a cutout portion of the second back wall, and wherein the header has a first, folded down position for use during storage and transport, movable to a second, extended position for displaying graphical indicia relating to the product; and an upwardly moveable locking member for locking the header in its extended position, said locking member is provided with tabs for frictionally engaging the first and the second back walls in order to lock the header in its extended position.

* * * * *